US005514226A

United States Patent [19]

Terrat et al.

[11] Patent Number: 5,514,226

[45] Date of Patent: May 7, 1996

[54] SALT BATH COMPOSITION BASED ON ALKALI NITRATES FOR OXIDIZING FERROUS METAL TO IMPROVE ITS CORROSION RESISTANCE

[75] Inventors: Jean-Paul Terrat, Saint-Etienne; Philippe Maurin-Perrier, Saint Marcellin En Forez; Daniel Viviani, Meyzieu, all of France

[73] Assignee: Centre Stephanois de Recherches Mecaniques Hydromecanique et Frottement, Andrezieux-Boutheon, France

[21] Appl. No.: 375,894

[22] Filed: Jan. 20, 1995

[30] Foreign Application Priority Data

Feb. 9, 1994 [FR] France ..... 94 01448

[51] Int. Cl.$^6$ ..... C23C 2/04

[52] U.S. Cl. ..... 148/242

[58] Field of Search ..... 148/242

[56] References Cited

U.S. PATENT DOCUMENTS

| | | | |
|---|---|---|---|
| 2,639,244 | 5/1953 | Vordahl et al. | 148/6.11 |
| 3,912,547 | 10/1975 | Gaucher et al. | 148/6.11 |
| 4,006,043 | 2/1977 | Gaucher et al. | 148/27 |
| 4,292,094 | 9/1981 | Kunst et al. | 148/6.11 |
| 4,448,611 | 5/1984 | Grellet et al. | 148/6.11 |

FOREIGN PATENT DOCUMENTS

| | | |
|---|---|---|
| 2171993 | 9/1973 | France . |
| 2271307 | 12/1975 | France . |
| 2463821 | 2/1981 | France . |
| 2525637 | 10/1983 | France . |

OTHER PUBLICATIONS

Penjagina, "Passivierung von Eisen und Nickel in geschmolzenen Carbonaten", Werkstoffe und Korrosion, Nov. 1, 1972, vol. 23, No. 11, p. 1046.

Akihiko Satomi, "Surface treatment of iron member for increasing corrosion and wear resistance", Patent Abstracts of Japan, Dec. 21, 1982, vol. 6, No. 261.

*Primary Examiner*—Sam Silverberg

*Attorney, Agent, or Firm*—Young & Thompson

[57] ABSTRACT

A salt bath composition is adapted to form a layer of magnetite $Fe_3O_4$ on the surface of ferrous metal parts, including nitrided ferrous metal parts, to protect the underlying iron against corrosion. This layer is impermeable and of good crystalline order, as indicated by a deep black color and a corrosion potential greater than 1 000 mV. The composition includes at least nitrate anions and sodium and lithium cations, the latter in a proportion by weight relative to the bath between 0.1% and 5%, preferably between 0.5% and 1.75%. Preferred compositions contain sodium, potassium and lithium cations and nitrate, carbonate and hydroxyl anions, within the following percentage ranges:

$8.5 \leqq CO_3^{2-} \leqq 26$ $15 \leqq NO_3^- \leqq 41.5$ $4.7 \leqq OH^- \leqq 21.5$ Apart from the exceptional reliability of the oxidation treatment, the presence of lithium associated with the sodium and the potassium and with the nitrate or carbonate anions reduces the formation of carbonate-containing sludge in the bath, probably because the composition forms ternary mixtures of nitrate or carbonate with a low melting point.

5 Claims, No Drawings

SALT BATH COMPOSITION BASED ON ALKALI NITRATES FOR OXIDIZING FERROUS METAL TO IMPROVE ITS CORROSION RESISTANCE

BACKGROUND OF THE INVENTION

1. Field of the Invention

The invention concerns a salt bath composition for surface oxidation treatment of ferrous metal parts, including nitrided parts, to increase their corrosion resistance, the treatment being carried out at a temperature between 320° C. and 550° C., the composition including at least nitrate anions, sodium cations and where appropriate potassium alkali cations.

2. Description of the prior art

Salt baths containing alkali metal nitrates have long been used to treat ferrous metal parts, including parts that have been previously nitrided, to increase their corrosion resistance by forming a layer of magnetite $Fe_3O_4$ to protect the underlying iron.

Document FR-A-2 463 821 describes a process for treating nitrided ferrous metal parts by immersing the parts in a molten salt bath containing sodium and potassium hydroxides with 2% to 20% by weight of nitrates of these alkali metals for a period between 15 minutes and 50 minutes. The temperatures used are between 250° C. and 450° C. The corrosion resistance of parts treated in this way is greatly increased compared with parts which have only been nitrided.

Document FR-A-2 525 637 describes a process of the same kind specifically intended for ferrous metal parts containing sulfur, such as parts that have been nitrided in baths containing sulfur-containing substances. The oxidizing bath contains sodium and potassium cations and nitrate and hydroxyl anions. It preferably contains carbonate anions and 0.5% to 15% of an oxygenated alkali metal salt whose oxyreduction potential relative to the hydrogen reference electrode is less than or equal to −1 volt, such as a bichromate. An oxygenated gas is blown into the bath and the concentration of insoluble particles in the bath is maintained at less than 3% by weight. This produces good corrosion resistance (250 hours in the salt spray test) without deterioration of wear and fatigue resistance and there is an improvement in seizing resistance under conditions of dry rubbing.

However, it has been found that this performance cannot be achieved with the reliability and reproducibility required to meet industrial demands. Performance variations are relatively minor in the laboratory. They become much greater for treatment carried out on an industrial scale. They are particularly noticeable when large quantities of small parts are "bulk" treated or parts with imperfect surfaces are treated: the presence of disrupted areas such as pressing or punching burrs, crimping or bending creases and welding heterogeneities are all sources of defects and therefore of corrosion.

A random resistance to corrosion is totally unacceptable for parts such as jack or damper piston rods and automobile windshield wiper and starter motor spindles. The solution to this problem has for many years been to refresh the baths repeatedly, as and when required, according to the more or less aberrant results obtained. This solution is not satisfactory, in particular because of the industrial requirements mentioned previously.

The proportions of the bath constituents (hydroxides, carbonates, nitrate, bichromate) have been varied to improve reliability and corrosion resistance. Our investigations have shown that to achieve excellent corrosion resistance (i.e. more than 400 hours exposure to salt spray before the first appearance of traces of corrosion), the surface of the parts must be a uniform deep black color, typical of the formation of a layer of magnetite $Fe_3O_4$ with good crystalline order. At the same time, the corrosion potential in a 30 g/l NaCl solution relative to a saturated calomel electrode should be 1 000 mV to 1 300 mV, indicative of complete passivation.

The correlation between the oxyreduction potential of the oxygenated salt (e.g. bichromate) and the desirable corrosion potential should be noted.

However, baths containing alkali metal hydroxides, nitrates, carbonates and bichromate or permanganate require frequent testing of the bath composition and adjustment to the operating conditions specific to the parts if efficiency is to be maintained. Also, performance varies due to modification of the composition of the bath by consumption of reagents, soiling by residues on the parts due to previous treatments and reaction of the soiling materials with the bath constituents, entrainment of bath constituents with parts removed from the bath, and reaction of the hydroxides in the bath with carbon dioxide in the atmosphere; these performance variations occur despite periodic adjustment of the bath composition. In specific applications the strong oxidizing agent (bichromate) concentration is relatively critical.

Enrichment of the bath with carbonates due to oxidation of nitriding bath cyanates and absorption of carbon dioxide from the atmosphere lead to precipitation of carbonates that form a sludge at the bottom of the bath. Removal of this sludge entrains active constituents of the bath.

The invention concerns oxidizing bath compositions based on alkaline-earth metal nitrates which have a reliable and repetitive oxidizing power.

SUMMARY OF THE INVENTION

The invention therefore proposes a salt bath composition for surface oxidation treatment of ferrous metal parts, including nitrided ferrous metal parts, to increase their corrosion resistance, the treatment being carried out at a temperature between 320° C. and 550° C., the composition including at least nitrate anions and sodium cations and where appropriate potassium alkali cations, characterized in that it includes lithium cations substituted for sodium or potassium cations in a proportion by weight relative to the mass of the bath between 0.1% and 5%.

We have found that substituting lithium for sodium and possibly potassium in the proportions indicated above unexpectedly leads to baths which form magnetite layers of a uniform black on ferrous metal parts, the corrosion potential of the treated parts being systematically at least 1 000 mV, even for parts made from materials which are supposedly difficult to treat by oxidation, such as nitrided cast iron.

Note that the chemical properties of alkali metals are very similar, with the result that the person skilled in the art usually thinks that alkali metals can be substituted for each other to suit circumstances such as availability, cost, purity or stability. In salt baths the combination of cations is often chosen so that the mixture has a relatively low melting point and a sufficiently low viscosity at the working temperature of the bath.

We have not been able to elucidate exactly and precisely the physico-chemical mechanisms which, in baths in accordance with the invention, lead to the formation of ordered crystals and totally impermeable magnetite layers, as indicated by the uniformly black appearance of the surface of the parts and by the corrosion potential.

Based on the results obtained however, we suspect that the small atomic radius of lithium could play a decisive role. It is known that, because of its small atomic radius, lithium can penetrate into the crystal lattice of magnetite to form crystalline $Li_2Fe_3O_4$ which has clearly defined and constant crystal lattice parameters. It is thus possible that the lithium cation stabilizes the crystal lattice of the magnetite as the latter forms.

The concentration of lithium is preferably between 0.5% and 1.75% by weight; the corrosion resistance is most reliable and reproducible in this range of values.

In addition to nitrate anions and carbonate and hydroxyl anions, in stoichiometric equilibrium with the alkali metal cations, the preferred bath compositions contain proportions by weight of carbonate $CO_3^{2-}$, nitrite $NO_3^-$ and hydroxyl $OH^-$ anions within the following percentage ranges relative to the active or liquid mass of the bath:

$8.5 \leqq CO_3^{2-} \leqq 26$ $15 \leqq NO_3^- \leqq 41.5$ $4.7 \leqq OH^- \leqq 21.5$ These limits have been experimentally determined to provide an appropriate viscosity at the operating temperatures, with a low probability of uncontrolled reactions in the presence of reducing agents, whilst allowing for the likely relative concentrations of cations.

The aforementioned composition preferably contains significant proportions by weight of potassium.

We have also found that the presence of lithium in baths containing nitrate, hydroxyl and carbonate anions reduces the quantity of sludge formed by the precipitation of carbonates. This effect appears to be particularly marked if the concentrations of lithium and potassium cations and carbonate or nitrate anions are substantially equivalent to a ternary alkali (sodium, potassium and lithium) nitrate or carbonate eutectic.

Since the concentration of lithium has been determined to form ordered crystalline magnetite layers, the concentrations of carbonate or nitrate anions and of potassium cations are related to the lithium concentration as follows:

for the carbonate eutectic:

$9 \times Li^+ < CO_3^{2-} < 11 \times Li^+$ $2.7 \times Li^+ < K^+ < 3.2 \times Li^+$ for the nitrate eutectic:

$30 \times Li^+ < NO_3^- < 36 \times Li^+$ $10 \times Li^+ < K^+ < 12.5 \times Li^+$ In all cases the sodium concentration is stoichiometric.

Features and advantages of the invention will emerge from the following description illustrated by examples.

DETAILED DESCRIPTION OF THE INVENTION

EXAMPLE 1

An oxidizing salt bath was prepared by melting a mixture of 365 kg of sodium nitrate, 365 kg of sodium hydroxide, 90 kg of sodium carbonate, 90 kg of potassium carbonate and 90 kg of lithium carbonate and heating the mixture to 450° C.

The percentage ionic concentrations were therefore as follows:

| anions | | cations | |
|---|---|---|---|
| $NO_3^-$ | 26.6 | $Na^+$ | 34.7 |
| $CO_3^{2-}$ | 16.3 | $K^+$ | 5.1 |
| $OH^-$ | 15.6 | $Li^+$ | 1.7 |

Non-alloy 0.38% carbon steel test pieces previously sulfonitrided as disclosed in documents FR-A-2 171 993 and FR-A-2 271 307 (immersion for 90 minutes in a salt bath at 570° C. containing 37% cynanate anions and 17% carbonate anions, the cations being $K^+$, $Na^+$and $Li^+$, the bath also containing 10 ppm to 15 ppm of $S^{2-}$ ions) were treated in this bath for five minutes.

The treated test pieces had a particularly uniform and decorative black color. Crystallographic analysis of the test pieces by X-ray diffraction showed that the majority substance present was magnetite $Fe_3O_4$; there was a minor proportion of mixed oxide $Li_2Fe_3O_4$;

In an electrochemical corrosion test using voltametric analysis on an aerated 30 g/l NaCl solution, the corrosion potential measured relative to the saturated calomel electrode was in a range from 1 000 mV to 1 300 mV, indicative of total passivation of the parts, according to the technical information we have collected on assessing the quality of oxidizing salt bath treatment.

Note that the measured potentials of 1 000 mV to 1 300 mV correspond in fact to the inherent oxidation potential of the NaCl solution; it is not possible to measure a real corrosion potential if it is at least as high as the oxidation potential of the test solution.

Weekly cleaning of a salt bath of the invention used daily for production to remove the sludge deposited at the bottom of the crucible removed 70 kg of salts containing 60% by weight of carbonates.

Note that the ternary eutectic of carbonates of sodium, potassium and lithium had the composition 33.2% $Na_2CO_3$, 34.8% $K_2CO_3$ and 32% $Li_2CO_3$. The composition of the carbonates in the bath (33.3% for each) was very close to that of the eutectic.

Comparative trials

Two experimental baths were made up with no lithium.

The first bath contained 330 kg of sodium nitrate, 330 kg of sodium hydroxide, 330 kg of sodium carbonate and 10 kg of sodium bichromate, giving the following percentage ionic concentrations:

| anions | | cation | |
|---|---|---|---|
| $NO_3^-$ | 24.1 | $Na^+$ | 42.3 |
| $OH^-$ | 14 | | |
| $CO_3^{2-}$ | 18.8 | | |
| $CR_2O_4^{2-}$ | 0.8 | | |

The second bath contained 150 kg of sodium nitrate, 530 kg of sodium hydroxide and 320 kg of sodium carbonate, i.e. a percentage ionic composition:

| anions | | cations | |
|---|---|---|---|
| $NO_3^-$ | 11 | $Na^+$ | 48.3 |
| $OH^-$ | 22.5 | | |

-continued

| anions | | cations | |
|---|---|---|---|
| $CO_3^{2-}$ | 18.2 | | |

The treatment conditions (temperature 450° C., duration five minutes) were as for the first example. The results were as follows:

All the test pieces treated were covered with a black layer of magnetite $Fe_3O_4$.

The test pieces treated in the first comparative bath were uniformly black; their corrosion potential was between 1 000 mV and 1 300 mV, from which it may be concluded that the oxide layer was passive.

The test pieces treated in the second comparative bath were mainly black, with some showing brown highlights. The corrosion potential varied between 250 mV and 1 300 mV. It may be concluded that the quality of the magnetite layer varied from one test piece to another and that the second comparative bath did not offer sufficient reliability.

Weekly cleaning of the two experimental baths used daily for production removed approximately 150 kg of sludge containing approximately 60% carbonate.

From the point of view of mechanical and tribological properties, the bath from example 1 and the first comparative bath yielded entirely equivalent results.

EXAMPLE 2

An oxidizing salt bath was produced from 365 kg NaOH, 270 kg $Na_2CO_3$, 62 kg $NaNO_3$, 277 kg $KNO_3$ and 76 kg $LiNO_3$. The nitrates were divided between the three alkali cations in proportions of 14.9% $NaNO_3$, 66.8% $KNO_3$and 18.3% $LiNO_3$, substantially equivalent to the ternary eutectic. The corresponding percentage ionic concentrations by weight were as follows:

| anions | | cations | |
|---|---|---|---|
| $NO_3^-$ | 28.2 | $Na^+$ | 34.3 |
| $CO_3^{2-}$ | 15.4 | $K^+$ | 10.8 |
| $OH^-$ | 15.5 | $Li^+$ | 0.77 |

Nitrided cast iron test pieces were treated in this bath using the same operating conditions as in Example 1 and in the comparative examples. The treated test pieces were uniformly black, the surface layer was preponderantly magnetite $Fe_3O_4$ and the corrosion potential was in the range from 1 000 mV to 1 300 mV.

Similar nitrided cast iron test pieces were treated in the first and second comparative baths described above and were an irregular brownish red color. X-ray diffraction analysis indicated that the surface layer was preponderantly magnetite, but that the crystal order was irregular, the X-ray diffraction spectrum showing anomalies compared to standard (ASTM) spectra for magnetite.

Weekly cleaning of the bath from example 2 containing 0.77% lithium and used daily for production removed about 80 kg of sludge.

EXAMPLE 3

Two experimental baths were prepared containing only nitrate anions. Bath A contained 48.5% $KNO_3$, 39.5% $NaNO_3$ and 12% $LiNO_3$, with the following percentage ionic concentrations:

| anions | | cations | |
|---|---|---|---|
| $NO_3^-$ | 70.3 | $Na^+$ | 13.1 |
| | | $K^+$ | 15.4 |
| | | $Li^+$ | 1.2 |

A comparative bath B was prepared containing 55% $NaNO_3$ and 45% $KNO_3$, i.e. the following ionic percentages:

| anions | | cations | |
|---|---|---|---|
| $NO_3^-$ | 67.6 | $Na^+$ | 14.9 |
| | | $K^+$ | 17.5 |

Nitrided cast iron test pieces were treated in these baths (immersed for 15 minutes at 400° C.).

The test pieces treated in bath A all had a deep black surface layer. The test pieces treated in bath B had a grey surface layer with brown highlights.

The corrosion potentials, determined in the same way as previously, were in the range from 1 000 mV to 1 300 mV in the case of the test pieces treated in bath A and in a range from 300 mV to 900 mV in the case of those treated in bath B, with the expected consequences as to their corrosion resistance.

Note that the comparative examples corresponding to examples 2 and 3 confirm the known difficulty of protecting nitrided cast iron against corrosion and demonstrate the efficacy of the baths of the invention.

With reference to example 3, the parts treated must have all traces of residues from the nitriding bath carefully removed, because pure nitrate baths are liable to react violently on contact with reducing substances.

With reference to the reduced formation of carbonate sludge in baths containing hydroxides, nitrates and carbonates, we found that the reduction in sludge formation appeared to be optimal if the concentrations by weight of a nitrate or carbonate anion, in conjunction with the concentration of potassium and lithium cations, corresponded to the presence in the bath of a ternary eutectic of the anion with the $Na^+$, $K^+$ and $Li^+$ cations.

As the efficacy of formation of an ordered crystalline magnetite layer depends on the concentration by weight by lithium, the rule for obtaining the optimum combination of the two effects is to choose the lithium concentration appropriate to formation of the protective magnetite layer and then, on the basis of this concentration, to determine the potassium and carbonate or nitrite anion concentration from the ternary eutectic composition of that anion.

Thus, for the carbonate anion:

$9 \times Li^+ < CO_3^{2-} < 11 \times Li^+$ $2.7 \times Li^+ < K^+ < 3.2 \times Li^+$ and for the nitrate anion:

$30 \times Li^+ < NO_3^- < 36 \times Li^+$ $10 \times Li^+ < K^+ < 12.5 \times Li^+$ Of course, in all cases, the sodium cation will be in excess of the composition of the ternary eutectic, because of the presence of anions other than the anion taken into consideration for the eutectic and because the bath must be in stoichiometric equilibrium.

It goes without saying that the invention is not limited to the examples described but encompasses all variant executions thereof within the scope of the claims.

There is claimed:

1. Salt bath composition for surface oxidation treatment of ferrous metal parts, including nitrided ferrous metal parts, to increase their corrosion resistance, the treatment being carried out at a temperature between 320° C. and 550° C., the composition comprising nitrate anions, carbonate and hydroxyl anions, sodium alkali cations, optionally potassium alkali cations, and lithium cations substituted for sodium or potassium alkali cations, wherein said nitrate anions $NO_3-$, carbonated anions $CO_3^{2-}$and hydroxyl anions $OH^-$are in stoichiometric equilibrium with the alkali metal cations and in proportions by weight within the following percentage ranges relative to the active or liquid mass of the bath:

$8.5 \leqq CO_3^{2-} \leqq 26$ $15 \leqq NO_3^- \leqq 41.5$ $4.7 \leqq OH- \leqq 21.5$ and wherein said lithium cations are in a proportion by weight relative to the mass of the bath between 0.1% and 5%.

2. Composition according to claim 1 wherein the concentration by weight of lithium cations is between 0.5% and 1.75%.

3. Composition according to claim 1, containing potassium cations.

4. Composition according to claim 3 containing concentrations by weight of carbonate $CO_3^{2-}$ anions and potassium $K^+$ cations relative to the concentration by weight of lithium $Li^+$ cations as follows:

$9 \times Li^+ < CO_3^{2-} < 11 \times Li^+$ $2.7 \times Li^+ < K^+ < 3.2 \times Li^+$ the sodium concentration being stoichiometric.

5. Composition according to claim 3 containing concentrations by weight of nitrate $NO_3^-$ anions and potassium $K^+$ cations relative to the concentration by weight of lithium $Li^+$ cations as follows:

$30 \times Li^+ < NO_3^- < 36 \times Li^+$ $10 \times Li^+ < K^+ < 12.5 \times Li^+$ the sodium concentration being stoichiometric.

* * * * *

UNITED STATES PATENT AND TRADEMARK OFFICE

CERTIFICATE OF CORRECTION

PATENT NO. : 5,514,226

DATED : May 7, 1996

INVENTOR(S) : Jean-Paul TERRAT et al.

It is certified that error appears in the above-indentified patent and that said Letters Patent is hereby corrected as shown below:

Column 4, line 57, change "$CR_2O_4^{2-}$" to --$Cr_2O_7^{2-}$--.

Signed and Sealed this

Fifteenth Day of October, 1996

*Attest:*

*Attesting Officer*

BRUCE LEHMAN

*Commissioner of Patents and Trademarks*